US006877265B2

(12) United States Patent
Hajjar et al.

(10) Patent No.: US 6,877,265 B2
(45) Date of Patent: Apr. 12, 2005

(54) SYSTEM AND METHOD FOR INCREASED MAGAZINE CAPACITY FOR A FIREARM

(75) Inventors: Jeffrey Hajjar, Boise, ID (US); Warren Stockton, Meridian, ID (US)

(73) Assignee: Snake River Machine, Inc., Meridian, ID (US)

( * ) Notice: Subject to any disclaimer, the term of this patent is extended or adjusted under 35 U.S.C. 154(b) by 0 days.

(21) Appl. No.: 10/382,568

(22) Filed: Mar. 6, 2003

(65) Prior Publication Data

US 2004/0020093 A1 Feb. 5, 2004

Related U.S. Application Data

(60) Provisional application No. 60/363,837, filed on Mar. 14, 2002, and provisional application No. 60/387,346, filed on Jun. 10, 2002.

(51) Int. Cl.[7] ..... F41A 9/72
(52) U.S. Cl. ..... 42/19; 42/49.01
(58) Field of Search ..... 42/17, 19, 49.01; 89/139, 33.02, 33.1

(56) References Cited

U.S. PATENT DOCUMENTS

| | | | |
|---|---|---|---|
| 202,613 | A | 4/1878 | White |
| 224,742 | A | 2/1880 | Swingle |
| 580,679 | A | 4/1897 | Davenport |
| 601,843 | A | 4/1898 | McClean |
| 618,369 | A | 1/1899 | Wilson |
| 1,115,979 | A | 11/1914 | Sillix |
| 1,420,471 | A | 6/1922 | Carter |
| 1,734,852 | A | 11/1929 | Frampton et al. |
| 2,482,398 | A | 9/1949 | Blanton et al. |
| 3,698,115 | A | 10/1972 | Henning |
| 3,757,449 | A | 9/1973 | Schindler |
| 3,991,501 | A | 11/1976 | Larsson |
| 4,821,442 | A | 4/1989 | Bock |
| 4,905,395 | A | 3/1990 | Wagner |
| 5,054,221 | A | 10/1991 | Ozols |
| 5,119,575 | A | 6/1992 | Gajdica |
| 5,367,810 | A | 11/1994 | Stead et al. |
| 5,400,536 | A | 3/1995 | Milliman |

FOREIGN PATENT DOCUMENTS

EP 0 559 416 A1 9/1993

OTHER PUBLICATIONS

Combat shotguns [online], [material copied Jul., 2002] Retrieved using Internet <URL:http://world.guns.ru/shotgun/SH00–E.HTM>.

*Primary Examiner*—J. Woodrow Eldred
(74) *Attorney, Agent, or Firm*—Factor & Lake

(57) ABSTRACT

A system and method for providing increased capacity to a firearm having an actuator operably connected to a trigger assembly is disclosed. A magazine for holding a cartridge for use with the firearm includes a plurality of tubes, each tube being defined within the magazine and including an open end. The plurality of tubes being axisymmetric about a longitudinal axis of the magazine. A retainer, mounted about the open end of the tubes and being adaptive to impede release of the cartridge from the open end of the tube, being operably meshed with the actuator wherein the retainer and the actuator cooperate to permit removal of the cartridge from one of the plurality of tubes.

47 Claims, 5 Drawing Sheets

SYSTEM AND METHOD FOR INCREASED MAGAZINE CAPACITY FOR A FIREARM

RELATED APPLICATIONS

This application claims the benefit of U.S. Provisional Patent Application Ser. No. 60/363,837, entitled "Large Capacity Ammunition Magazine And Cooperating Semi-Automatic Shotgun," filed Mar. 14, 2002, and U.S. Patent Provisional Application Ser. No. 60/387,346, entitled "Large Capacity Ammunition Magazine And Cooperating Semi-Automatic Shotgun," filed Jun. 10, 2002. These applications are incorporated herein by reference.

TECHNICAL FIELD

This invention relates generally to the field of firearms, and more particularly, to increasing a firearm's magazine capacity.

BACKGROUND OF THE INVENTION

Throughout the history of the firearm, particularly as to an instrument of warfare and defense, its development has been guided by the purpose of rapidly firing a large amount of projectiles while requiring minimal reloading. The shotgun is one particular firearm that has been an effective close-range weapon. Although the shotgun has been proven effective as an entry weapon wherein close-quarters impairs the use of long-barreled and/or high-powered weapons, its limited ammunition capacity, lack of interchangeability among ammunition types, and relative lengthy reloading time renders today's shotgun less than adequate in an urban-combat arena.

Various governmental and private security agencies throughout the world have expressed a desire for a compact, detachable, magazine-fed shotgun for tactical operations in close-quarters. Unfortunately, today's sporting shotguns adapted for law enforcement and military purposes provide an unsatisfactory option for many tactical situations.

The present invention is provided to solve these and other problems.

SUMMARY OF THE INVENTION

One embodiment of the present invention is directed to a magazine for holding a cartridge for a firearm having an actuator operably connected to a trigger assembly. The magazine comprises a plurality of tubes being defined within the magazine. The tubes are axisymmetric about a longitudinal axis and include a first—open—end and a second end. A retainer is mounted about the first ends of the tubes and is adaptive to impede the release of the cartridge from the magazine. The retainer is operably meshed with the firearm's actuator wherein the retainer and the actuator cooperate to permit removal of the cartridge from the magazine.

A further aspect of the above embodiment includes a bias, e.g., spring, contained within the magazine for urging the cartridge toward the open end of the tube wherein the retainer, actuator, and bias cooperate to expel the cartridge from the magazine in response to movement of the firearm's trigger assembly and subsequent motion of the actuator. The retainer further comprising a plurality of leaves axisymmetrically aligned with the longitudinal axis of the magazine wherein the plurality of leaves being adaptive to impede release of the cartridge from the open ends of the tubes. A portion of the retainer overlaps a portion of one of the plurality of tubes when the magazine is viewed perpendicularly to a plane normal to the longitudinal axis of the magazine.

Further aspects of the present invention include an index assembly and a connector assembly. The index assembly is operably connected to the magazine and adaptive for rotating the magazine about its longitudinal axis. The index assembly is capable of aligning a selected tube for transfer of the cartridge from the magazine to the firearm. The connector assembly operably connects the magazine to the firearm. The connector assembly is further adaptive for detaching the magazine from the firearm.

Yet another aspect of the present invention is a firearm comprising an actuator being operably connected to a trigger assembly. The firearm further includes a magazine having a longitudinal axis and including a plurality of tubes being defined within the magazine. The plurality of tubes being axisymmetric about the longitudinal axis. A retainer mounted about the open end of the plurality of tubes is adaptive to impede the release of ammunition from the magazine. The retainer is operably meshed with the actuator wherein the retainer and the actuator cooperate to permit removal of ammunition from the tube.

An object of the present invention is to provide a mechanism for increasing the capacity of a firearm magazine.

Another object of the present invention is to provide a compact firearm with the capability to utilize various types of ammunition wherein a firearm operator can quickly select among several ammunition types for rapid firing.

Yet a further object of the present invention is to provide a compact weapon capable of delivering a variety of munitions without removing the magazine.

These and other aspects and attributes of the present invention will be discussed with reference to the following drawings and accompanying specification.

DETAILED DESCRIPTION

Figure 1:
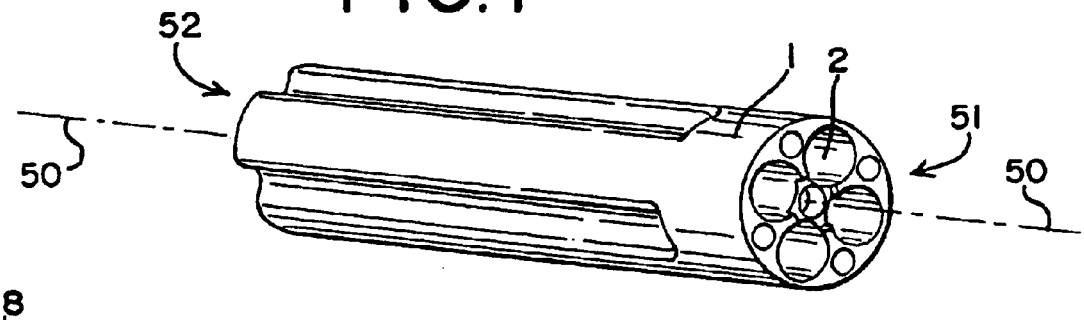
FIG. 1 is a perspective view of a magazine of the present invention.

While this invention is susceptible to embodiments in many different forms, there are shown in the drawings and will herein be described in detail, preferred embodiments of the invention with the understanding that the present disclosures are to be considered as exemplifications of the principles of the invention and are not intended to limit the broad aspects of the invention to the embodiments illustrated.

Figure 2:
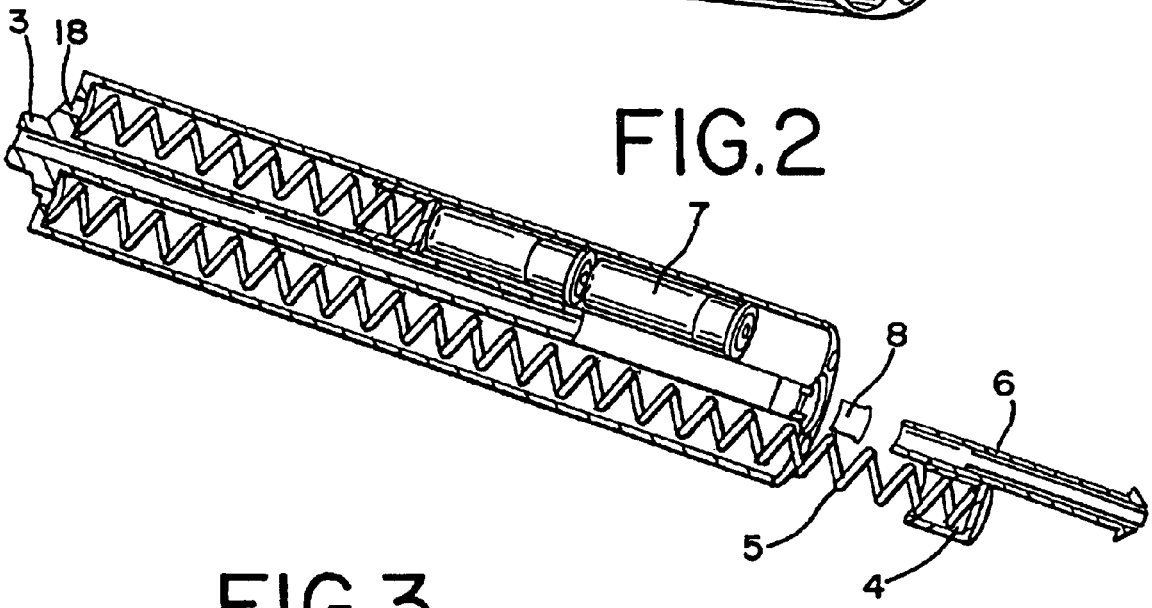
FIG. 2 is a perspective cross-sectional view of the magazine of the present invention.

Referring to the drawings in detail, wherein similar reference characters designate corresponding parts throughout the several views, one embodiment of the present invention shown in FIGS. 1 and 2 is a magazine 1 for holding a cartridge 7 for use with a firearm 54 shown in FIGS. 6–9. The firearm 54 includes an actuator 33 operably connected to a trigger assembly 65 shown in FIG. 8. The magazine 1 comprises a plurality of tubes 2 being defined within the magazine and axisymmetric about a longitudinal axis 50. Each tube 2 is preferably cylindrically shaped and includes a first end 51 and a second end 52—the first end is open. A retainer 6 is mounted about the open end 51 of the tubes 2 and is adaptive to impede release of the cartridge 7 from the open end of the tube. When the magazine 1 is attached to the firearm 54, the retainer 6 is operably meshed with the actuator 33 wherein the retainer and the actuator cooperate to permit removal of the cartridge 7 from the magazine.

Figure 8:
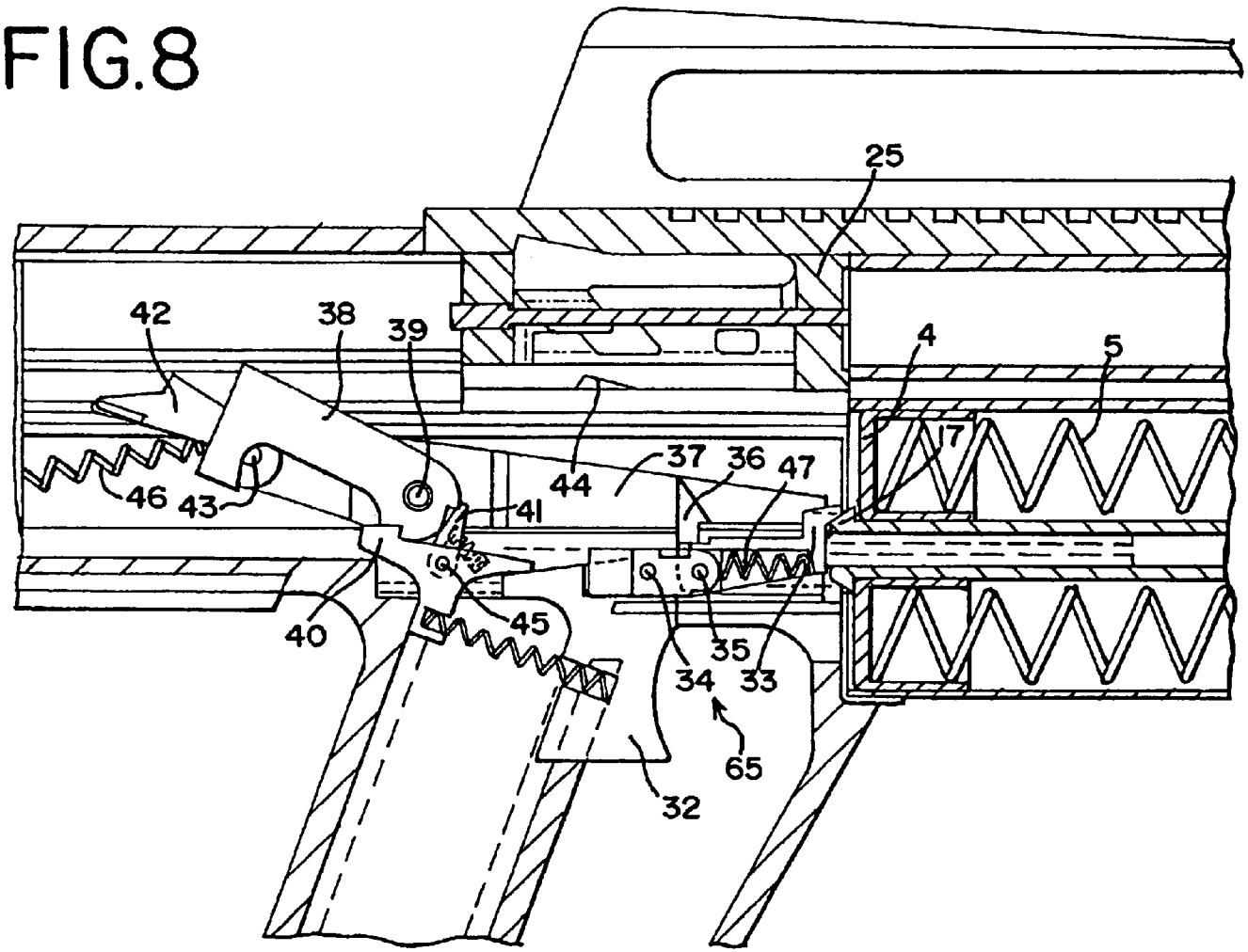
FIG. 8 is a partial cross-sectional view of one embodiment of the present invention; and, FIG. 9 is an alternate embodiment of the invention.

The magazine 1 further includes a bias 5, e.g., spring, contained within the magazine for urging the cartridge 7 toward the open end 51 of the tube 2 wherein the retainer 6, actuator 33, and bias cooperate to expel the cartridge from the magazine 1 in response to movement of the trigger assembly 65 and subsequent motion of the actuator. FIGS. 2 and 8 depict the bias 5 contained within each tube 2. The spring 5 is of a sufficient rate to effectively expel stored cartridges 7—lethal and non-lethal—releasably retained within the magazine 1 by the retainer 6. A follower 4 may be utilized between the spring 5 and the cartridge 7.

The retainer 6 further comprises a plurality of leaves 16 axisymmetrically aligned with the longitudinal axis 50 of the magazine 1 wherein the plurality of leaves impede the release of the cartridges 7 from the open ends 51 of the tubes 2. The plurality of leaves 16 may be affixed about the perimeter of the magazine 1 near the open ends 51 of the tubes 2.

Although the retainer 6 as depicted in FIG. 2 is secured along the longitudinal axis 50 of the magazine 1, it is to be understood that other means of retaining the cartridge and cooperating with the triggering assembly action of the firearm to transfer the cartridge from the magazine to the firearm 54 may be devised within the scope of the invention.

Alternatively, the retainer 6 may include a base 60 having a longitudinal axis 53 as shown in FIG. 2. The plurality of leaves 16 are connected to the base 60, and the base is coaxially aligned with the longitudinal axis 50 of the magazine 1. Additionally, as shown in FIG. 2, a collar 8 can be incorporated to retain the spring 5 and follower 4 within the ammunition tube 2. Preferably, the collar 8 includes a longitudinal axis in alignment with the longitudinal axis 50 of the magazine 1 and is secured to the magazine near the open ends 51 of the tubes 2. The collar 8 is of such diameter and design as to impede further travel of the follower 4, and spring 5, without impeding the cartridge 7 having a slightly smaller diameter.

Figure 4A:
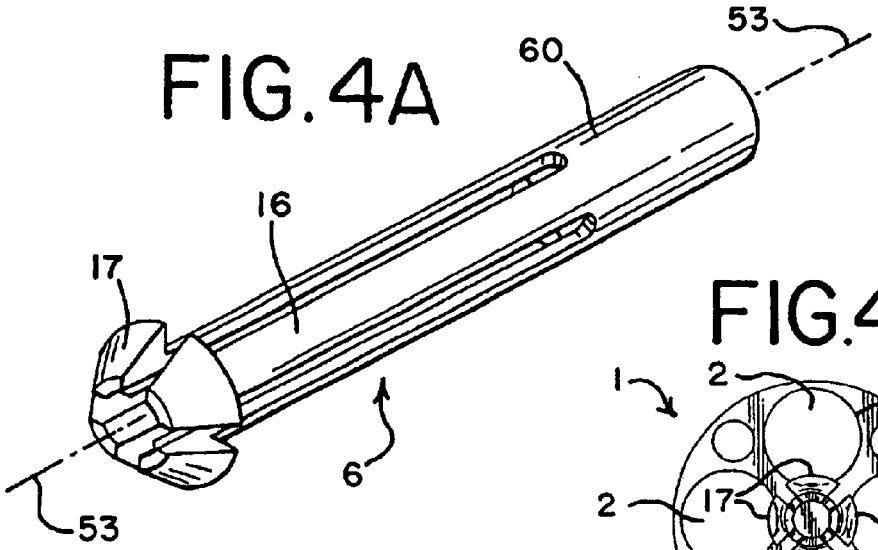
FIG. 4A is a perspective view of one embodiment of the retainer.
Figure 4B:
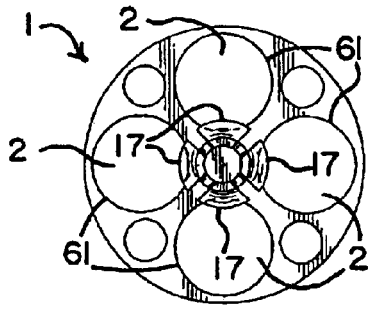
FIG. 4B is a view showing the relationship between the retainer and the plurality of tubes of one embodiment of the present invention when viewed in line with the longitudinal axis of the magazine.

Referring to FIGS. 2, 4A, 4B, and 8, the retainer 6 is mounted about the open end 51 of the tubes 2 and preferably comprises a plurality of leaves 16. Each leaf 16 is associated with one or more tubes 2. Each leaf 16 is of sufficient stiffness to maintain its corresponding portion 17 in the path of the cartridge 7 against the force of the spring 5. Although a portion 17 of a single leaf 16 may cooperate effectively with more than one of the tubes 2—and vice versa—it is preferable that an exclusive relationship exists between each one of the plurality of tubes 2 and each one of the plurality of leaves 16 wherein a portion 17 of the retainer 6 overlaps an associated portion of one of the plurality of tubes 2 when viewed perpendicularly to a plane normal to the longitudinal axis 50 of the magazine 1. FIGS. 4A and 4B depict such a tube-retainer relationship between each of the plurality of leaves 16 and each of the plurality of tubes 2 wherein each portion 17 of the leaf 16 is substantially parallel to a plane substantially normal to the longitudinal axis 51 of the magazine 1. The portion 17 of the leaf 16 intersects a circumference 61 of the associated tube 2. The tube circumference 61 includes the surface of the tube 2 and extends beyond the ends of the tube.

Referring now to FIGS. 3 and 5–7, the magazine 1 further includes a means for indexing a selected tube 2 for alignment with the receiver 28 of the firearm 54. An index assembly 66 is operably connected to the magazine 1 and adaptive for rotating the magazine about its longitudinal axis 50. The index assembly 66 is capable of aligning one of the plurality of tubes 2 when attached to the firearm 54.

Pushing a release button 20 attached to a spring-loaded 21 detent 11 releases the magazine 1 from its present position wherein the magazine can be rotated to index the desired tube in position for injecting ammunition 7 into the firearm 54. A number of cartridges 7 can be sequentially cycled through the firearm 54 utilizing one tube 2. Between firings, the magazine 1 may be manually advanced at any time to present another tube 2, or the magazine may be quickly removed and replaced by another magazine. Additionally, different types of munitions 7 may be loaded into different tubes 2 in one magazine 1 to allow the firearm operator to select and index to the desired munitions without having to remove the magazine, which would otherwise render the firearm operator momentarily disarmed. The selectability of tubes 2 provides the firearm operator with the ability to utilize various types of ammunition, e.g., lethal, non-lethal. As such, the firearm 54 is adaptive to various situations requiring lethal and non-lethal responses without having to disengage the magazine 1 from the firearm.

As an example, one tube 2 can be loaded with teargas canisters, another tube can be loaded with non-lethal projectiles, e.g., rubber bullets, and another tube can be loaded with lethal ammunition. A situation may arise wherein an initial non-lethal response is required. After a period of time, the severity of the situation may escalate wherein use of a lethal response may be warranted. The firearm 54 of the present invention can be readied for an appropriate response by indexing the tubes 2 so that the lethal ammunition is positioned for feeding into the firearm. Thus, the firearm operator can quickly adapt to changing situations by either advancing the magazine 1 to the appropriate tube 2 or quickly removing one magazine for another, without having to individually remove each cartridge 7 from the magazine prior to reloading the magazine with another type of ammunition.

To facilitate adaptation of the magazine 1 and/or firearm to the various levels of response, an indicator can be utilized to identify the type of ammunition stored in the magazine and cylinder 2. The indicator, e.g., color, letter, marking, shape, or combination thereof; is preferably located on an outer portion of the magazine 1 or tube 2 for identification by the firearm user. The user can confirm alignment of a desired ammunition type by inspecting the position of the indicator with respect to the firearm.

The magazine 1 also includes means for connecting the magazine to the firearm 54. Referring again to FIGS. 3 and 5–7, a connector assembly 67 is affixed about the second end of the magazine 1 and is adaptive for attachment to the firearm 54. The connector assembly 67 preferably includes a round boss 3 wherein the magazine 1 can be attached and detached with the firearm 54. The magazine 1 may be removed from the firearm 54 by depressing the upper forward surface 19 of the pivot cup 9, shown in FIG. 5, and simultaneously pulling down on the end of the magazine 1. In the preferred embodiment, the magazine 1 serves as the fore-end or forward holding surface of the firearm 54. Thus, the operator's forehand is always in position to index and/or release the magazine 1. In the preferred embodiment of the invention, removal of the magazine 1 can be accomplished with one hand.

Figure 3:
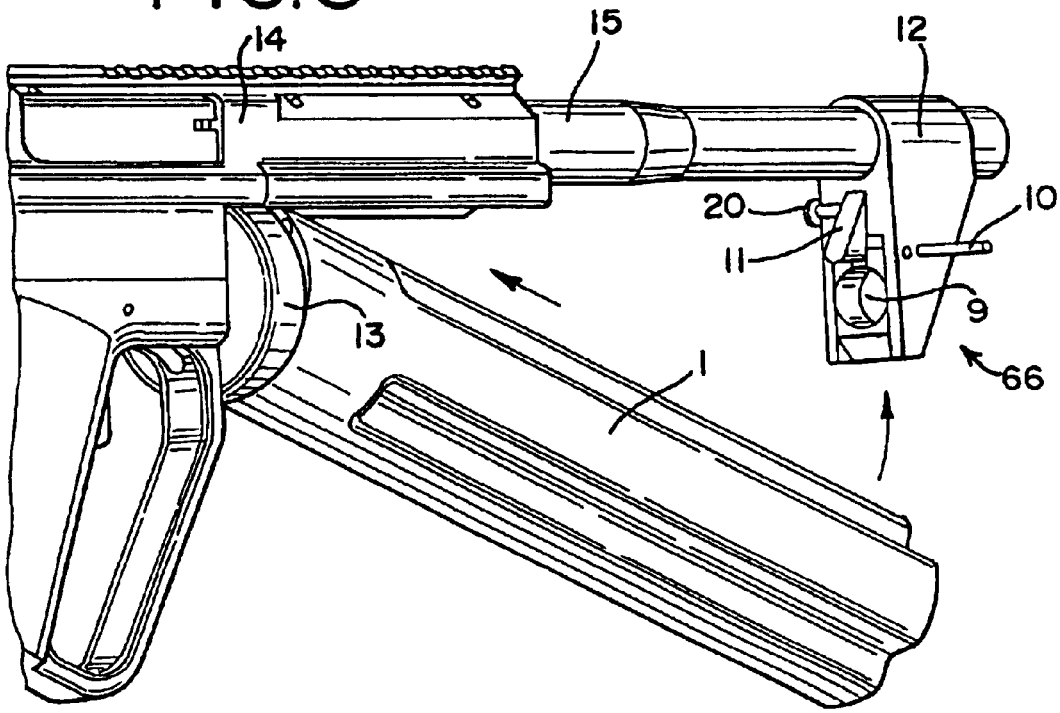
FIG. 3 is a partial perspective view of one embodiment of the present invention showing the magazine and the firearm.
Figure 5:
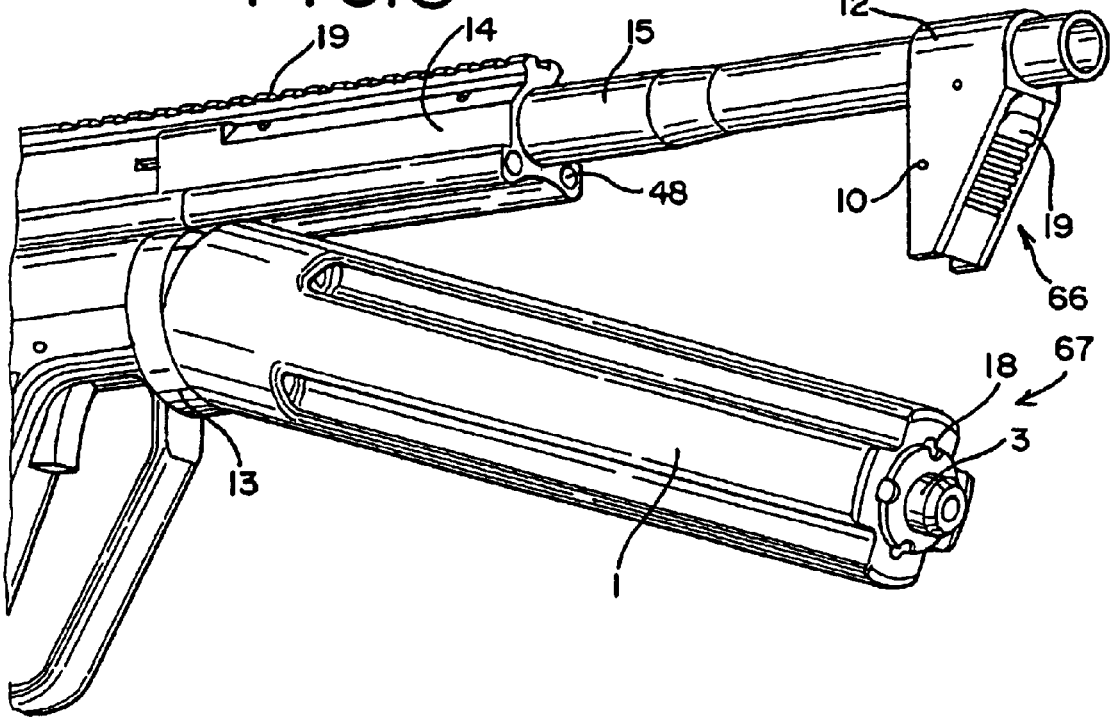
FIG. 5 is a partial perspective view of the magazine and cooperating firearm of one embodiment of the present invention.
Figure 7:
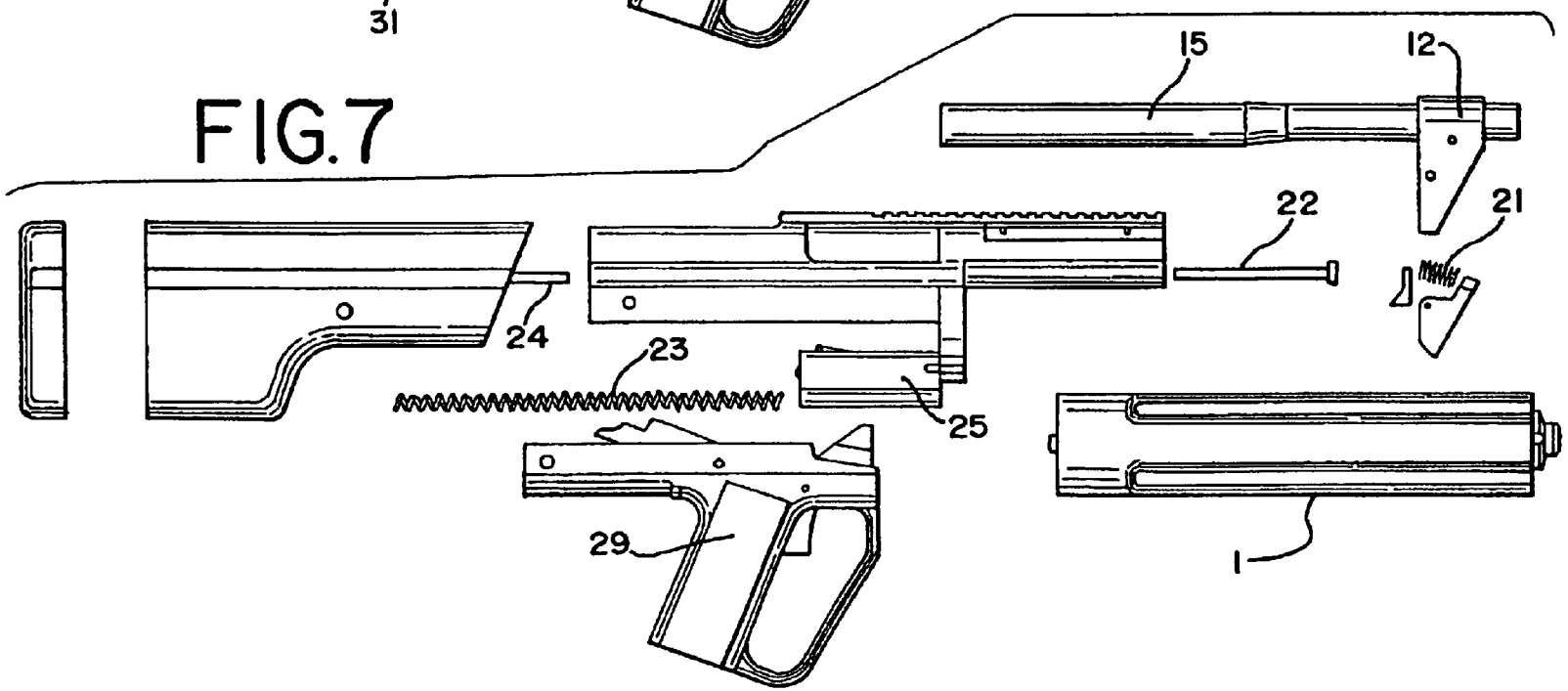
FIG. 7 is an exploded view of the firearm shown in FIG. 6.

As shown in FIGS. 3, 5, and 7, the magazine 1 is attached to the firearm 54, e.g., semi-automatic shotgun, by inserting the end of the magazine proximate the open ends of the tubes 2 into a shallow cylindrical well 13 that is fixed to, and part of, a firearm receiver 28. The opposite end of the magazine 1 can be moved upward so that a round boss 3 snaps into the spring-loaded 21 hinged-cup 9 that pivots on an axle 10 of a bracket 12 attached to a forward end of a firearm barrel 15. The magazine 1 is retained parallel to and below the barrel 15—free to rotate around its longitudinal axis 50. The magazine 1 is aligned by the index assembly 66 wherein the detent 11 snaps into an appropriate socket 18 aligned with the one of the plurality of tubes 2 in which the tube is in position to release the cartridge 7 into the firearm 54.

It is to be understood that alternate means of retaining and indexing the magazine 1 in an operable position using regularly spaced indentures about the longitudinal axis 50 can be easily devised within the scope of the present invention.

One embodiment of the firearm's 54 trigger assembly 65, carrier assembly, and receiver assembly are shown in FIG. 8. The trigger assembly 65 is operably meshed with the actuator 33. Pulling of the trigger 32 momentarily displaces the actuator 33 to dislocate the portion 17 of one of the plurality of leaves 16 being operably aligned with the actuator. Ammunition 7 is released by the dislocated portion 17 of the leaf 16 and transfers into the firearm 54 for subsequent firing.

Mechanisms for cooperating with a high-capacity magazine 1 and for releasing, receiving, and maneuvering ammunition into a barrel 15, as well as the hammer, safety, and firing mechanism, are preferably contained within a pistol-grip lower receiver 29 and are of relatively conventional design common to sporting semi-automatic shotguns well known to those familiar with firearm design. The magazine 1 is detachably affixed to the firearm 54, parallel to, and under the shooting barrel 15 wherein a selected one of a plurality of ammunition tubes 2 can be aligned with a receiver assembly of the firearm.

Figure 6:
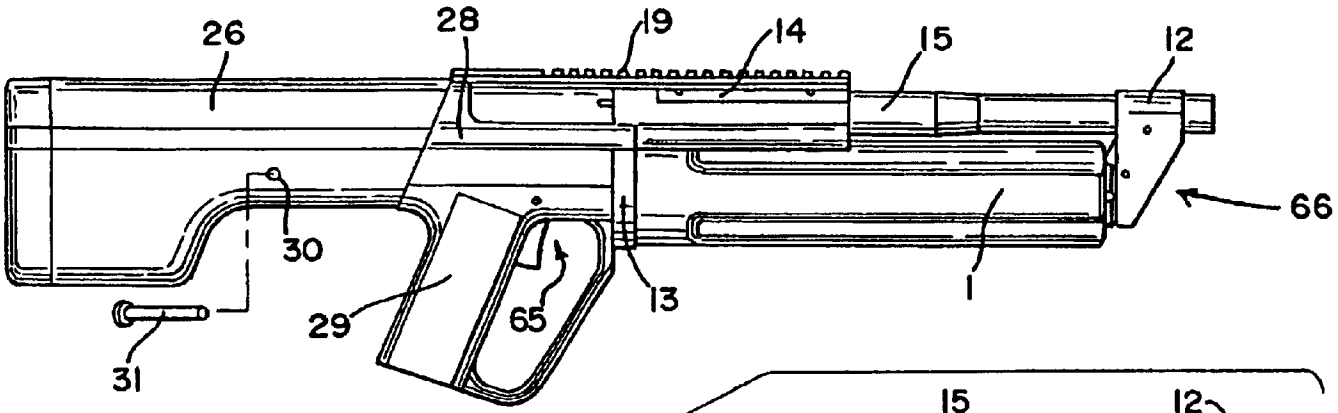
FIG. 6 is a view of one embodiment of the firearm of the present invention.

The preferred embodiment of the present invention shown in FIGS. 5–7 is a gas-operated semi-automatic shotgun 54 having two pistons 22 in bores 48 symmetrically arranged parallel to, and in close proximity with, the barrel 15 and magazine 1. The pistons 22 and bores 48 are of appropriate diameter and stroke to unlock a conventional bolt 25 and propel it rearward in the receiver 28 when a cartridge 7 is fired and a portion of the propellant gas is vented from the barrel 15 into the piston bores 48. The bolt 25 is then propelled forward by springs 23 on guide rods 24 fixed to a buttstock 26—engaging the conventional feed mechanism and returning to battery. Preferably, the buttstock 26 and pistol grip are fixed to the receiver 28 by an alignment pin 31 in a hole 30 common to several sub-assemblies. It is to be understood that other arrangements of the basic elements of the firearm 54 and other types of operating systems, e.g., inertia, retarded-blowback, etc., common to firearm design could be easily devised within the scope of the present invention.

The trigger assembly 65 of the preferred embodiment depicted in FIG. 8 utilizes elements common to semi-automatic shotguns including a trigger 32 that pivots on a first pin 34; a sear 40 and a disconnect 41 that pivot on a second pin 45; a hammer 38 and a shell carrier 37 that pivot on a third pin 39; and a shell carrier pawl 42 that pivots on a fourth pin 43 in the shell carrier 37. The device of the present invention comprises a magazine 1 including a retainer 6 being centrally located among the plurality of ammunition tubes 2. The retainer 6 is meshed with an operably connected actuator 33. The actuator 33 is operably connected to the trigger assembly 65 of the firearm 54, e.g., pivotally attached to the first pin 34, wherein the actuator 33 and retainer 6 cooperate to allow cartridges to be removed from the tubes 2.

More specifically, a shell carrier latch 36 being pivotable about a fifth pin 35 is held in a ready-position by a latch spring 47. When the trigger 32 is pulled, the shell carrier latch 36 engages and pulls down on the actuator 33, which in turn pulls down on the portion 17 of the retainer 6 and releases a shell cartridge to be propelled rearward by the spring 5 and follower 4. The released shell impinges on the shell carrier latch 36 and disengages it from the shell carrier 37 and the actuator 33—thus allowing the retainer portion 17 of the leaf 16 to return back into position to retain the next shell within the tube 2. As the shell carrier 37 is released, it is caused to rotate about its axis by the shell carrier pawl 42 which is engaged in a notch 44 in the bolt 25, which is urged forward by the bolt return springs 23. As the shell carrier 37 rotates and lifts the shell cartridge, the shell carrier pawl 42 disengages from the bolt 25, allowing the bolt to push the shell ahead of it into the firing chamber. As the forward-moving bolt 25 clears the shell carrier pawl 42, the shell carrier spring 46 causes the shell carrier 37 to rotate back to its original position, re-engaging the shell carrier latch 36. If there is no shell in position to feed when the trigger 32 is pulled, the shell carrier 37 is not released and the bolt is retained in its rearmost position by the shell retainer pawl 42 after it has been propelled backward by the expanding gas of the cartridge just fired. This functionality provides that when the bolt 25 is locked back, the firearm operator knows the magazine tube 2 is empty and may index to the next tube in the magazine 1 or load another magazine. Manual means to disengage the shell carrier latch 37 without pulling the trigger 32 can be easily devised, thus allowing the firearm operator to close the bolt 25 on an empty chamber.

The disclosed receiver and trigger assembly configurations by which the trigger assembly 65 cooperates with the magazine 1 are only those of the preferred embodiment. It is to be understood that the present invention is not limited to the receiver and trigger assembly disclosed and that various other assemblies known to those of ordinary skill in the art of firearms can be easily devised—or adapted—and utilized to cooperate with the actuator 33 to mesh with the retainer 6; and is considered to be within the scope of the present invention.

Figure 9:
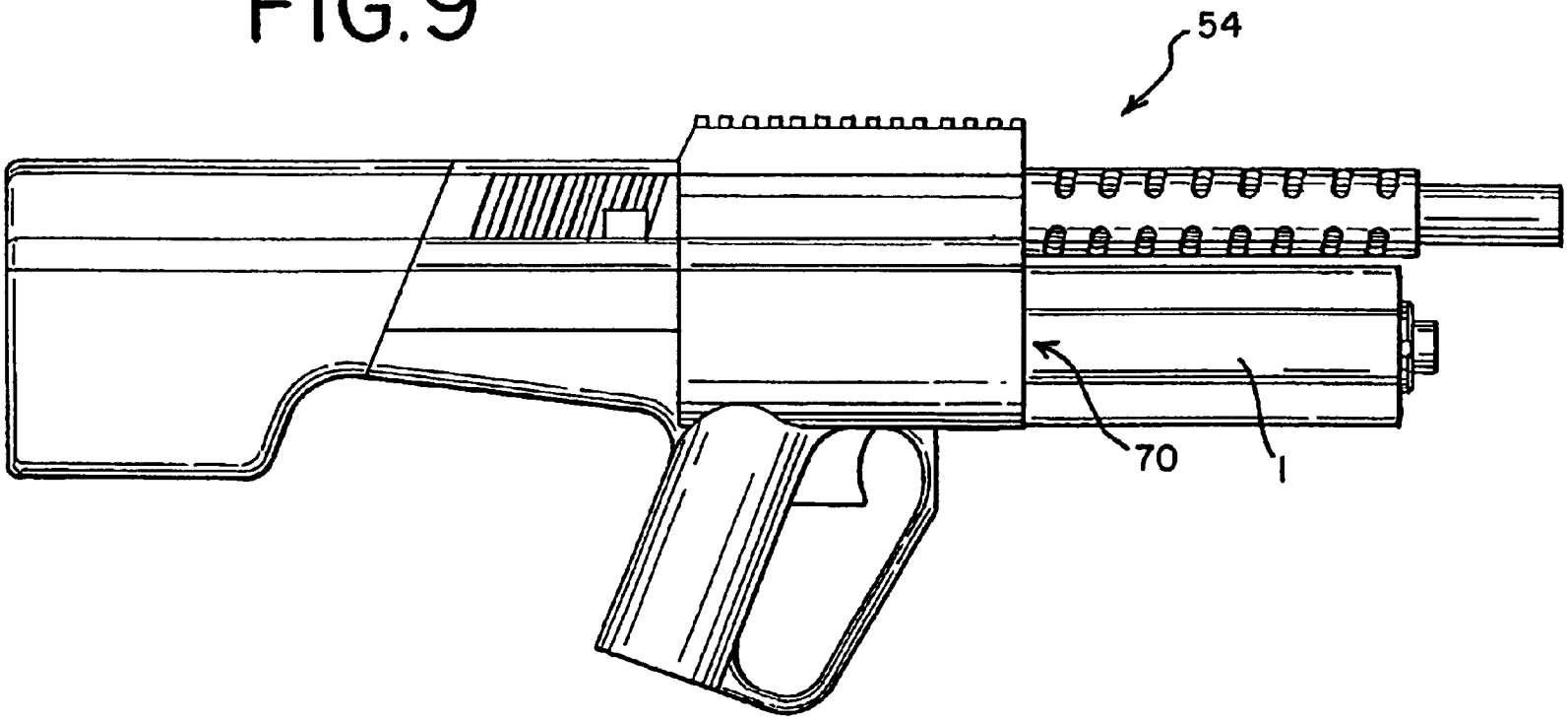

FIG. 9 depicts an alternate configuration wherein the magazine 1 may be inserted into a cylindrical well 70 of a shotgun with suitable means to removably retain the magazine and engage the regular indentures about its circumference for indexing purposes. In such a case, the elements of the cooperating action of the firearm can be suitably reconfigured.

The preferred embodiment of the present invention incorporates certain design features specifically directed toward tactical operations by law enforcement and military personnel operating in close-quarters such as apartment buildings and aboard ships. Several desired characteristics of the firearm include automatic or semi-automatic firing action; a short overall length; lightweight; minimal snagging protuberances; and corrosion-resistant materials—suitable for close-quarter tactical situations. The firearm 54 is also capable of incorporating an accessory mounting rail 19 integral to the receiver 28 consistent with mil-spec 1911 for attaching aiming and illuminating devices (not shown).

The firearm 54 is preferably designed for ease and relative low cost of manufacture—utilizing molded, machined, or fabricated plastic material for the magazine 1, pistol-grip lower receiver, and buttstock; metal die-stamping for the receiver and action parts; investment casting for the trunnion block 14, and bolt parts to minimize expensive machining operations.

The size of the firearm 54 and the number of ammunition tubes 2 incorporated within the magazine 1 is dependent upon the firearm manufacturer's preference. In one embodiment, the dimensions of the firearm include an overall length of 28 in., a height of 7 in., and a fully loaded weight of approximately 9 pounds. It may be preferable to utilize a magazine 1 having four cylindrical tubes 2, as five may be too large to securely and comfortably grasp for the average hand, while three tubes may require a greater degree of rotation between indexed tubes. Each tube 2 can hold four shot shells, e.g., 2¾ in., 12 gauge; for a total of sixteen rounds per magazine 1. It is also to be understood other configurations having more or less capacity and larger or smaller munitions could easily be devised within the scope of the invention.

It will be understood that the invention may be embodied in other specific forms without departing from the spirit or central characteristics thereof. The present embodiments, therefore, are to be considered in all respects as illustrative and not restrictive, and the invention is not to be limited to the details given herein. While specific embodiments have been illustrated and described, numerous modifications come to mind without significantly departing from the characteristics of the invention and the scope of protection is only limited by the scope of the accompanying Claims.

We claim:

1. A magazine for holding a cartridge for use with a firearm, the firearm including an actuator being operably connected to a trigger assembly, the magazine comprising: a plurality of tubes being defined within the magazine and axisymmetric about a longitudinal axis, each tube including an open end; and, a retainer mounted about the open ends of the plurality of tubes, the retainer being adaptive to impede release of the cartridge from the magazine and being operably meshed with the actuator wherein the retainer and the actuator cooperate to permit removal of the cartridge from the magazine when the trigger is pulled.

2. The magazine of claim 1 further comprising a bias contained within the magazine for urging the cartridge toward the firearm wherein the retainer, actuator, and bias cooperate to expel the cartridge from the magazine in response to movement of the trigger assembly and subsequent motion of the actuator.

3. The magazine of claim 2 wherein the bias is contained within each one of the plurality of tubes.

4. The magazine of claim 3 wherein the bias a spring.

5. The magazine of claim 1 wherein the retainer further comprising a plurality of leaves axisymmetrically aligned with the longitudinal axis of the magazine wherein the plurality of leaves being adaptive to impede removal of the cartridge from the plurality of tubes.

6. The magazine of claim 5 wherein the retainer further comprising a base having a longitudinal axis, the plurality of leaves being connected to the base, the base being coaxially aligned with the longitudinal axis of the magazine.

7. The magazine of claim 5 wherein an exclusive relationship exists between each of the plurality of leaves and each of the plurality of tubes.

8. The magazine of claim 1 wherein a portion of the retainer overlaps a portion of one of the plurality of tubes when viewed perpendicularly to a plane normal to the longitudinal axis of the magazine.

9. The magazine of claim 1 further comprising an index assembly operably connected to the magazine and being adaptive for rotating the magazine about its longitudinal axis, the index assembly being capable of aligning one of the plurality of cylindrical tubes for transferring the cartridge when attached to the firearm.

10. The magazine of claim 9 further comprising a connector assembly having a first mechanism and a second mechanism, the first mechanism being mounted about the second end of the magazine and the second mechanism being mounted to the firearm wherein the first and second mechanisms cooperate to attach the magazine to the firearm.

11. The magazine of claim 10 wherein the connector assembly includes a pivot and a pivot cup.

12. The magazine of claim 11 wherein the connector assembly being adaptive for detaching the magazine from the firearm.

13. The magazine of claim 1 further comprising a connector assembly having a first mechanism and a second mechanism, the first mechanism being mounted about the second end of the magazine and the second mechanism being mounted to the firearm wherein the first and second mechanisms cooperate to attach the magazine to the firearm.

14. The magazine of claim 13 wherein the connector assembly includes a pivot and a pivot cup.

15. The magazine of claim 14 wherein the connector assembly being adaptive for detaching the magazine from the firearm.

16. The magazine of claim 1 wherein an amount of the plurality of cylindrical tubes is greater than two.

17. A magazine for holding a cartridge for a firearm, the firearm including an actuator being operably connected to a trigger assembly, the magazine comprising: a housing having a longitudinal axis, a first end, and a second end, the first end of the housing being open; a plurality of cylindrical tubes being defined within the housing, each one of the plurality of cylindrical tubes including an open end and a longitudinal axis wherein all longitudinal axes are in a parallel spaced relationship with each other; a means for retaining being mounted about the open ends of the cylindrical tubes, the means for retaining impeding release of the cartridge from the cylindrical tubes, the means for retaining meshing with the actuator wherein the means for retaining and the actuator cooperate to permit removal of the cartridge from the housing when the trigger is pulled.

18. The magazine of claim 17 further comprising a means for biasing contained within the magazine for urging the cartridge toward the firearm wherein the means for retaining, the actuator, and the means for biasing cooperate to expel the cartridge from the magazine in response to movement of the trigger assembly and subsequent motion of the actuator.

19. The magazine of claim 18 wherein the means for biasing is contained within each one of the plurality of tubes.

20. The magazine of claim 17 wherein the means for retaining further comprising a plurality of leaves axisymmetrically aligned with the longitudinal axis of the magazine wherein the plurality of leaves impeding removal of the cartridge from the plurality of cylindrical tubes.

21. The magazine of claim 20 wherein the means for retaining further comprising a base having a longitudinal axis, the plurality of leaves being connected to the base, the base being coaxially aligned with the longitudinal axis of the housing.

22. The magazine of claim 20 wherein an exclusive relationship exists between each one of the plurality of leaves and each one of the plurality of cylindrical tubes.

23. The magazine of claim 17 wherein a portion of the means for retaining overlaps a portion of one of the plurality of tubes when viewed perpendicularly to a plane normal to the longitudinal axis of the magazine.

24. The magazine of claim 17 further comprising a means for indexing being operably connected to the magazine and being adaptive for rotating the magazine about its longitudinal axis, the means for indexing being capable of aligning one of the plurality of cylindrical tubes for transferring the cartridge when attached to the firearm.

25. The magazine of claim 24 further comprising a means for connecting being operably connected to the housing for attaching and detaching the magazine to the firearm.

26. The magazine of claim 17 further comprising a means for connecting being operably connected to the housing for attaching and detaching the magazine to the firearm.

27. The magazine of claim 17 wherein an amount of the plurality of cylindrical tubes is greater than two.

28. A firearm comprising: an actuator being operably connected to a trigger assembly; a magazine having a longitudinal axis, the magazine for holding a cartridge; a plurality of tubes being defined within the magazine and axisymmetric about the longitudinal axis, each tube including an open end; and, a retainer mounted about the open ends of the plurality of tubes, the retainer being adaptive to impede release of the cartridge from the magazine and being operably meshed with the actuator wherein the retainer and the actuator cooperate to permit removal of the cartridge from the magazine when the trigger is pulled.

29. The firearm of claim 28 further comprising a bias contained within the magazine for urging ammunition toward the open end of the tube wherein the retainer, actuator, and bias cooperate to expel ammunition from one of the plurality of tubes in response to a force imparted on the trigger assembly and subsequent movement of the actuator.

30. The firearm of claim 29 wherein the bias is contained within each one of the plurality of tubes.

31. The firearm of claim 30 wherein the bias a spring.

32. The firearm of claim 28 wherein the retainer further comprising a plurality of leaves axisymmetrically aligned with the longitudinal axis of the magazine wherein the plurality of leaves being adaptive to impede removal of the cartridge from the plurality of tubes.

33. The firearm of claim 32 wherein the retainer further comprising a base having a longitudinal axis, the plurality of leaves being connected to the base, the base being coaxially aligned with the longitudinal axis of the magazine.

34. The firearm of claim 32 wherein an exclusive relationship exists between each of the plurality of leaves and each of the plurality of tubes.

35. The firearm of claim 28 wherein a portion of the retainer overlaps a portion of one of the plurality of tubes when viewed perpendicularly to a plane normal to the longitudinal axis of the magazine.

36. The firearm of claim 28 further comprising an index assembly operably connected to the magazine and being adaptive for rotating the magazine about its longitudinal axis, the index assembly being capable of aligning one of the plurality of cylindrical tubes for transferring the cartridge when attached to the firearm.

37. The firearm of claim 36 further comprising a connector assembly having a first mechanism and a second mechanism, the first mechanism being mounted about the second end of the magazine and the second mechanism being mounted to the firearm wherein the first and second mechanisms cooperate to attach the magazine to the firearm.

38. The firearm of claim 37 wherein the connector assembly includes a pivot and a pivot cup.

39. The firearm of claim 38 wherein the connector assembly being adaptive for detaching the magazine from the firearm.

40. The firearm of claim 28 further comprising a connector assembly having a first mechanism and a second mechanism, the first mechanism being mounted about the second end of the magazine and the second mechanism being mounted to the firearm wherein the first and second mechanisms cooperate to attach the magazine to the firearm.

41. The firearm of claim 40 wherein the connector assembly includes a pivot and a pivot cup.

42. The firearm of claim 41 wherein the connector assembly being adaptive for detaching the magazine from the firearm.

43. The firearm of claim 28 wherein an amount of the plurality of cylindrical tubes is greater than two.

44. The firearm of claim 28 being semi-automatic.

45. The semi-automatic firearm of claim 44 being a shotgun.

46. The firearm of claim 28 being automatic.

47. The automatic firearm of claim 46 being a shotgun.

* * * * *